United States Patent [19]

Larsson

[11] 4,068,110

[45] Jan. 10, 1978

[54] METHOD AND APPARATUS FOR THE MANUFACTURE OF WELDED GRATINGS

[75] Inventor: Rolf Gösta Larsson, Laxa, Sweden

[73] Assignee: Elektriska Svetsningsaktiebolaget, Goteborg, Sweden

[21] Appl. No.: 669,624

[22] Filed: Mar. 23, 1976

[30] Foreign Application Priority Data

Mar. 25, 1975 Sweden ..... 7503487

[51] Int. Cl.[2] ..... B23K 11/10

[52] U.S. Cl. ..... 219/56; 219/58; 219/79; 219/161

[58] Field of Search ..... 140/112; 219/56, 58, 219/79, 107, 158, 161; 228/4.1, 6, 49, 185, 904

[56] References Cited

U.S. PATENT DOCUMENTS

| | | | |
|---|---|---|---|
| 2,164,043 | 6/1939 | Rössler | 219/56 X |
| 2,422,829 | 6/1947 | Fotie | 219/56 |
| 2,978,081 | 6/1961 | Stone | 140/112 X |
| 3,405,743 | 10/1968 | Robinson | 219/56 X |
| 3,497,659 | 2/1970 | Ritter et al. | 219/56 |

*Primary Examiner*—J. V. Truhe
*Assistant Examiner*—N. D. Herkamp
*Attorney, Agent, or Firm*—Lerner, David, Littenberg & Samuel

[57] ABSTRACT

In a plant for the manufacture of welded gratings composed of longitudinal members and crossbars welded to said longitudinal members, the crossbars are removed one at a time from a store to a retaining device capable of holding two crossbars at a predetermined horizontal spacing between each other. The pair of crossbars is discharged from said retaining device on to a carrying device arranged to carry the pair of crossbars into the welding station and deposit them on the longitudinal members there while still retaining their predetermined horizontal spacing.

3 Claims, 8 Drawing Figures

METHOD AND APPARATUS FOR THE MANUFACTURE OF WELDED GRATINGS

BACKGROUND OF THE INVENTION

The invention relates to the method of making welded gratings, steel mats and the like composed of longitudinal members and crossbars welded to said longitudinal members in which the longitudinal members are advanced longitudinally as a plane, horizontal array and the crossbars are successively applied across said array and welded two at a time to the longitudinal members in a welding station by the series spot welding process.

The welding of two crossbars at a time by the series spot welding process results in a high production capacity of the welding station. In existing plants employing said method, this advantage could not be fully utilized, as it was not possible to supply the crossbars to the welding station at the rate required to allow the welding station to operate at its maximum capacity.

SUMMARY OF THE INVENTION

The invention provides, in the manufacturing method above referred to, the improved method of handling, applying and welding the crossbars which comprises a. providing a store of crossbars, b. removing a first crossbar from said store to a first predetermined position at right angles to the longitudinal members of said array and located above a part of said array which is to enter the welding station, and holding said first crossbar in said predetermined position, c. removing a second crossbar from said store to a second predetermined position above a part of the array which is to enter the welding station, said first and second positions being on a level with and parallel to each other and spaced by a predetermined spacing, d. shifting said first and second crossbar simultaneously to the welding station along said array while maintaining said predetermined spacing between said crossbars, and e. simultaneously welding said first and second crossbars to the longitudinal members.

The invention also comprises an improved plant for the manufcture of welded gratings, steel mats or the like composed of longitudinal members and crossbars welded to said longitudinal members, of the general type comprising stationary guiding and supporting means defining a longitudinal path for a horizontal array of longitudinal elements, a welding station having spot welding electrodes provided above a portion of said longitudinal path and arranged to weld two crossbars at a time by the series spot welding process, means for advancing said array step by step along said path through said welding station, and means for successively supplying crossbars to said array to be welded thereto in the welding station. According to the invention, said last-mentioned means comprise a. a store of crossbars, b. crossbar supporting means provided above a portion of said longitudinal path passed by said array of longitudinal elements prior to its entering the welding station, said crossbar supporting means being arranged to support each of a pair of crossbars in a predetermined horizontal position in which said crossbars are parallel to each other and at right angles to the longitudinal elements and at a predetermined horizontal spacing from each other, including means for discharging said pair of crossbars downwards from their respective positions in said crossbar supporting means, c. means for removing one crossbar at a time from said store of crossbars to said crossbar supporting means along a lateral supply path including guide means arranged to be shifted between two positions to guide the crossbar towards one or the other of said predetermined horizontal positions, and operating means arranged to shift said guide means from one position to the other between the passage of a crossbar and the passage of the next succeeding crossbar, d. reciprocatory carrying means arranged to be horizontally displaced from a first terminal position between said crossbar supporting means and said path to a second terminal position in the welding station, and vice versa, said carrying means including rests for each of the crossbars of said pair, said rests being arranged in said first terminal position of said carrying means to register with the predetermined horizontal crossbar positions defined by said crossbar supporting means, and e. means for lowering said carrying means when in said second terminal position to deposit the pair of crossbars on the array of longitudinal members.

BRIEF DESCRIPTION OF THE DRAWINGS

In the appended drawings illustrating a preferred embodiment of the invention.

DETAILED DESCRIPTION OF THE EMBODIMENT SHOWN

Figure 1:
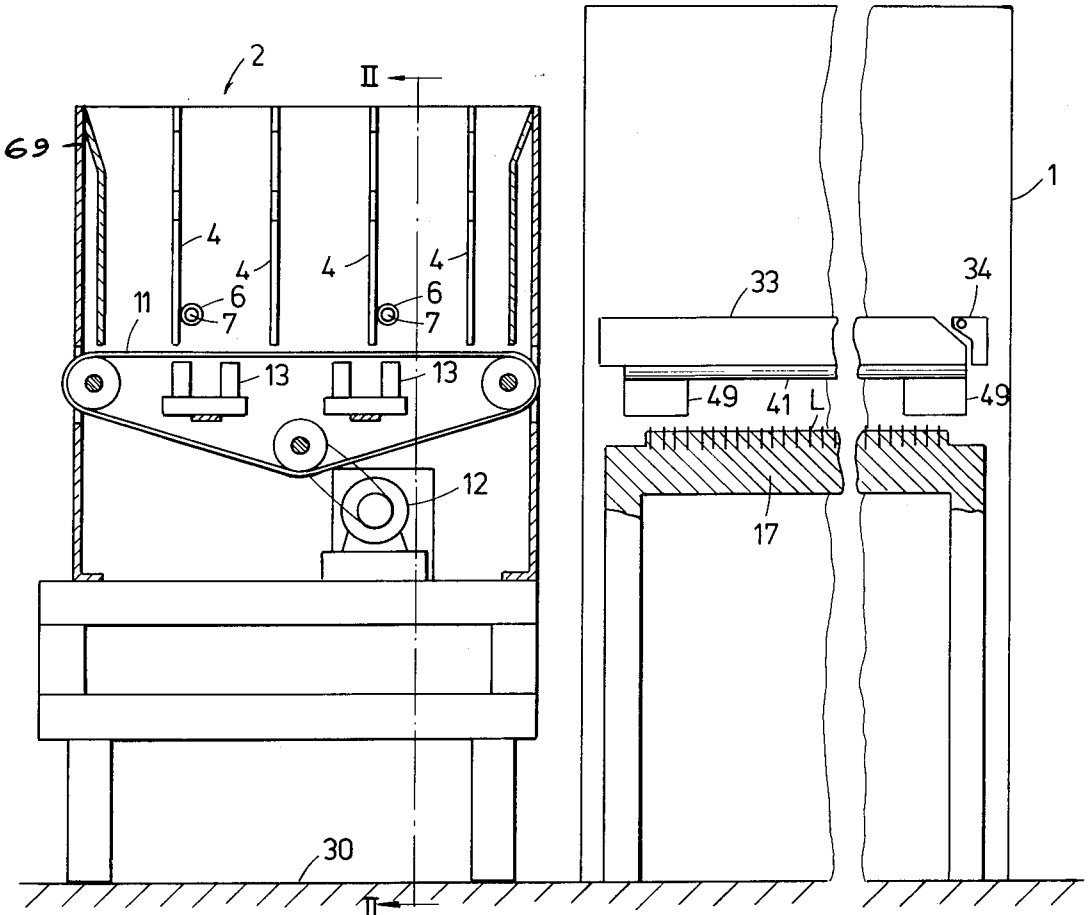
FIG. 1 is an elevational view, partially in section, of a crossbar storing and advancing unit placed beside a welding unit represented by a schematical rear elevation.
Figure 2:
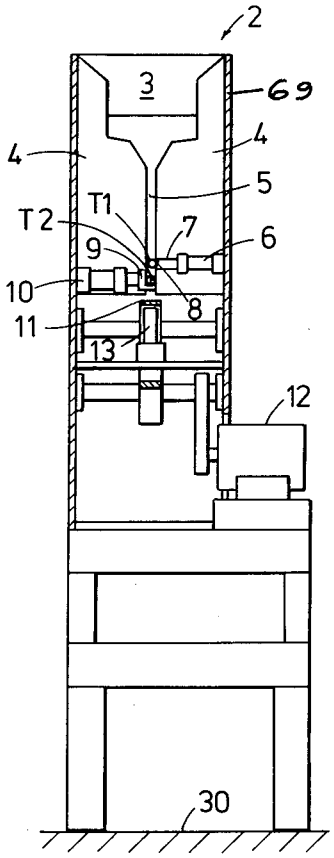
FIG. 2 is a sectional view taken on the line II—II of FIG. 1.

The crossbar storing and advancing unit 2 of FIGS. 1–2, which is supported by a shop floor or bedding 30 common to said unit and the welding unit 1, has a frame consisting of a rectangular casing 69 open at the top. The upper part of said casing encloses a crossbar storing space defined by the inner edges of several opposed flanges 4. The bottom portion of said storing space tapers towards vertical slots 5 between the lower portions of said flanges. Said slots have a width only slightly exceeding the thickness of the crossbars. When the unit is operating, said slots therefore enclose a single-layer vertical pile of parallel crossbars resting on each other. In FIG. 2, only the lowermost member T1 of said pile is shown. Said crossbar T1 engages the inclined front faces 8 of the piston rods 7 of a pair of cylinders 6. In the operative position represented, said front faces restrict the width of the vertical passage provided by the slots 5 so as to retain the crossbar T1 in the position shown. To release the crossbar T1, the cylinders 6 are caused through control means not represented to carry out a quick backward-forward stroke. The crossbar thus released is caught by a pair of brackets 9 each of which is attached to the piston rod of a cylinder 10. The brackets 9 accommodate one crossbar T2 only at a time. Retraction of the brackets 9 by means of the cylinders 10 causes the crossbar T2 to be pushed off the bracket by the left-hand edges (as viewed in FIG. 2) of the slots 5, so that the crossbar T2 will be discharged through the lower extremity of said slots.

Figure 3:
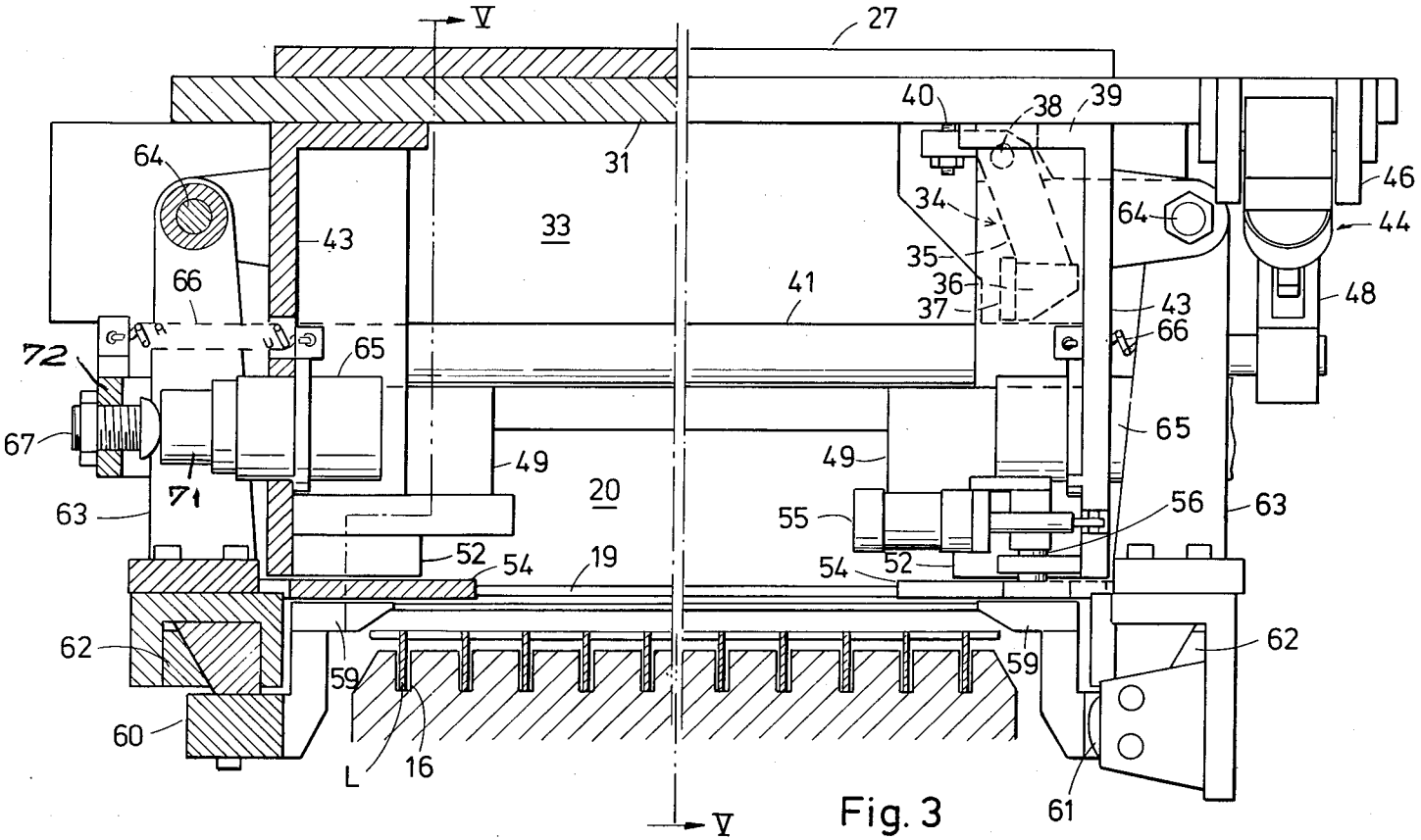
FIG. 3 is a rear elevational view, partially in sectional view taken on the line III—III of FIG. 4, and on a larger scale than FIGS. 1 and 2, of a crossbar receiving and handling station combined with the welding station into a structural unit.

A conveyor belt 11 driven by a motor 12 through suitable transmission means is arranged just below the slots 5 so as to catch the crossbar T2 discharged therefrom. Electromagnets 13 are provided below the conveyor belt to attract the crossbar and thus to increase the frictional engagement between the crossbar and the conveyor belt, in order to ensure a quick acceleration of the crossbar to the speed of the conveyor belt. The crossbar is advanced straight into a vertical chute 32 (FIG. 4) formed by an inverted U-bar 33 (FIGS. 1, 3, 4) supported by a support plate 31 attached to a frame 27 of the welding unit and extending transversely of the longitudinal members L to which the crossbars are to be welded to form a floor grating. Said longitudinal members L are guided by grooves 16 in a work table or bed 17 in the welding unit so as to form an array of spaced longitudinal members. Said table or bed extends forwards through a welding station provided with a pair of spot welding electrodes each of which comprises a composite electrode beam 20, 20*a* extending transversely of the longitudinal array of members L and a contact strip 19 fitted into the lower extremity of the lower part 20*a* of the composite beam. The upper part 20 of each of the electrode beams is rigidly supported by (but electrically insulated from) the frame 27. Each of the electrodes is connected to one terminal of the secondary 18 of a welding transformer. The frame 27 is vertically movable and is arranged to be operated by the piston rod or plunger 70 of a cylinder 28 supported by a stationary frame 29 of the welding unit. Said stationary frame 29, which does not have to be represented in detail, as well as the work table or bed 17, are supported by the common bedding or shop floor 30 already referred to.

A stop or buffer means 34 is provided for arresting the transverse motion of the crossbar shot into the chute 32 by the conveyor belt 11. Said buffer means comprise a lever 35 having a buffer head 36 provided with a buffer plate 37. The lever is supported for angular movement about a pivot 38 supported by a bracket 39 attached to the support plate 31. The gravity of the lever tends to turn the lever clockwise (in FIG. 3) towards a normal position determined by the engagement of an adjustment screw 40 with the supporting plate 31. The mass of the buffer head 36 is large compared to the mass of the crossbar. The amplitude of the rocking motion imparted to the lever 35 by the impact of the arriving crossbar will therefore be small.

Figure 7:
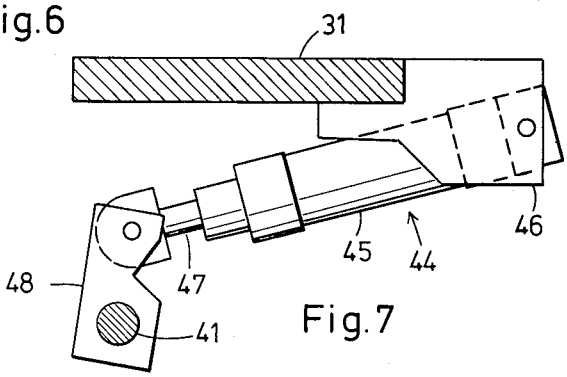
FIG. 7 is a side elevational view, partially in section, of certain parts of the unit of FIG. 3, FIG. 8 contains a number of diagrams illustrating the positions of the various operating cylinders of the crossbar handling mechanism in relation to the time.

An axle 41 extending across the work table or bed 17 near the discharge orifice of the chute 32 is rotatably supported at either end by a pair of brackets 42 each of which is supported by a member 43 attached to the support plate 31. A crank 48 fitted on the axle 41 is arranged to be operated by a mechanism 44 (FIG. 7) comprising a hydraulic or pneumatic cylinder 45 the piston rod 47 of which is jointed to the crank 48, while the cylinder itself is pivotably supported by a bracket 46 attached to the support plate 31. A pair of guide members 49 defining each a guide channel 50 are fitted to the ends of the axle 41 so as to catch and guide the end portions of the crossbars dropping down out of the chute 32. A pair of retaining blocks 52 attached each to one of the members 43 is arranged generally below said guide members so as to receive the end portions of the crossbars conveyed through the guide channels 50. Each of said retaining blocks has an arcuate upper surface 53 adapted to the path described by the guide 49 during its rotation, and four slots 51*a*, 51*b*, 51*c* and 51*d* opening into said arcute surface as well as downwards and inwards (that is, towards the corresponding slots of the other retaining block of the pair). A blocking plate 54 arranged at the substantially flat underside of each of the retaining blocks is supported for angular movement about a vertical pivot 56 and provided with four slots 57*a*, 57*b*, 57*c* and 57*d* corresponding to the slots 51*a*, 51*b*, 51*c* and 51*d* of the retaining block 52. A cylinder 55 is arranged to shift said blocking plate angularly between a blocking position, in which the slots 57*a* etc. form an angle with the slots 51*a* etc. of the retaining block, and a releasing position in which each of the slots 57*a* etc. of the blocking plate is aligned with the corresponding slot 51*a* etc. of the retaining block 52. In the blocking position of the blocking plate, the grooves 51*d* of the retaining blocks 52 and a selected pair of the grooves 51*a*, 51*b*, 51*c* of the retaining blocks serve as storage compartments for a pair of crossbars. The selection is effected by adjustment of the length of stroke of the cylinder 45 operating the axle 41 carrying the guide members 49, so that the guide members are caused to alternate between a position in which the guide channels 50 register with the slots 51*d* of the retaining blocks and a position in which the guide channels 50 register with a selected pair of slots, for instance the pair of slots 51*b*, of the retaining blocks. The chute 32, the guide channels 50 and the slots 51*a*, 51*b*, 51*c* and 51*d* of the retaining block should have a width considerably exceeding the width of the crossbars, for instance a width equal to twice the width of the crossbars, in order to ensure an unhampered passage of the crossbar under the action of gravity through the chute 32, the guide channel 50 and the slots of the retaining block 52.

Figure 5:
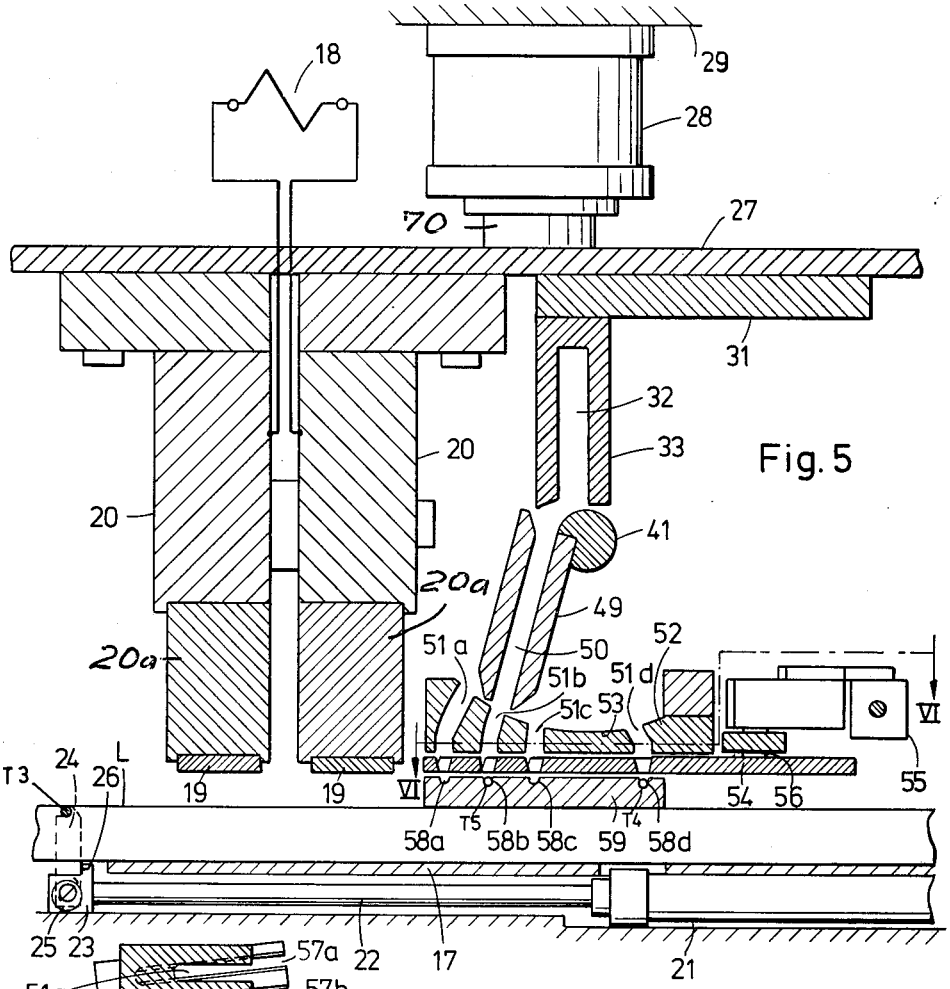
FIG. 5 is a sectional view taken on the line V—V of FIG. 3.
Figure 6:
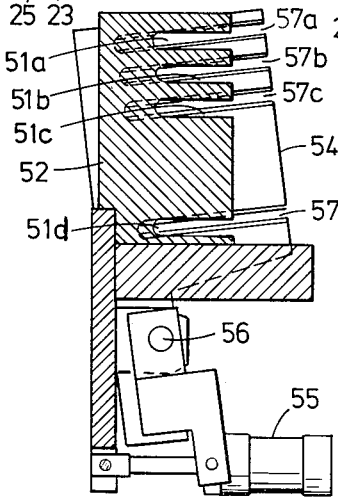
FIG. 6 is a sectional view taken on the line VI—VI of FIG. 5.

Each of a pair of carrying members 59 is arranged to be shifted longitudinally between a fetching position just below a corresponding one of the blocking plates and a delivery position in the welding station. Said carrying members are each provided with a set of rests or notches 58*a*, 58*b*, 58*c* and 58*d* the spacing of which corresponds to the one of the slots of the retaining block 52 and the blocking plate 54. In the fetching position of the carrying member, each of said rests or notches is aligned with a corresponding one of the slots of the retaining block 52 so as to catch the pair of crossbars discharged from the retaining block when the blocking plate is shifted into its releasing position. The width of each of the rests or notches is substantially equal to the width of the crossbars in order to provide a precise spacing of the crossbars. In FIG. 5, each of the rests or notches 58*b* and 58*d* of the carrying member 59 is shown to be occupied by a crossbar T5 and T4, respectively.

The retaining members 52, the blocking plates 54 and the carrying members 59 may be exchangeable, in order to provide a range of spacings in excess of the three different crossbar spacings provided by the set of members shown in the figures.

To provide the longitudinal movability of the carrying members 59 above referred to, each of said carrying members is supported by a slide member 60 longitudinally displaceable along guide means 62. A cylinder 61 is provided for each of said slide members to effect the shifting of the carrying member from the fetching position to the delivery position and vice versa. Each of the guide means 62 and the cylinders 61 is supported by a lever 63 angularly movable about a pivot 64 supported by a respective one of the members 43. A tension spring 66 for each of said levers 63 tends to pull the lever inwards towards the normal position shown, in which the head of a set screw 67 mounted in a bracket 72 on said lever engages the front face of the plunger 71 of a hydraulic cylinder 65.

It will be noted that the members 43 supporting the levers 63 are rigidly supported by the supporting plate 31 which is rigidly attached to the frame 27 carrying the welding electrodes **20, 20*a*, 19. Consequently, the levers 63 and the carrying members 59 supported by them as well as the inverted U-bar 33, the axle 41, the guide members 49, the retaining blocks 52 and the blocking plates 54 will share the vertical movement imparted to the electrodes by the cylinder 28 actuating the frame 27**.

Figure 8:
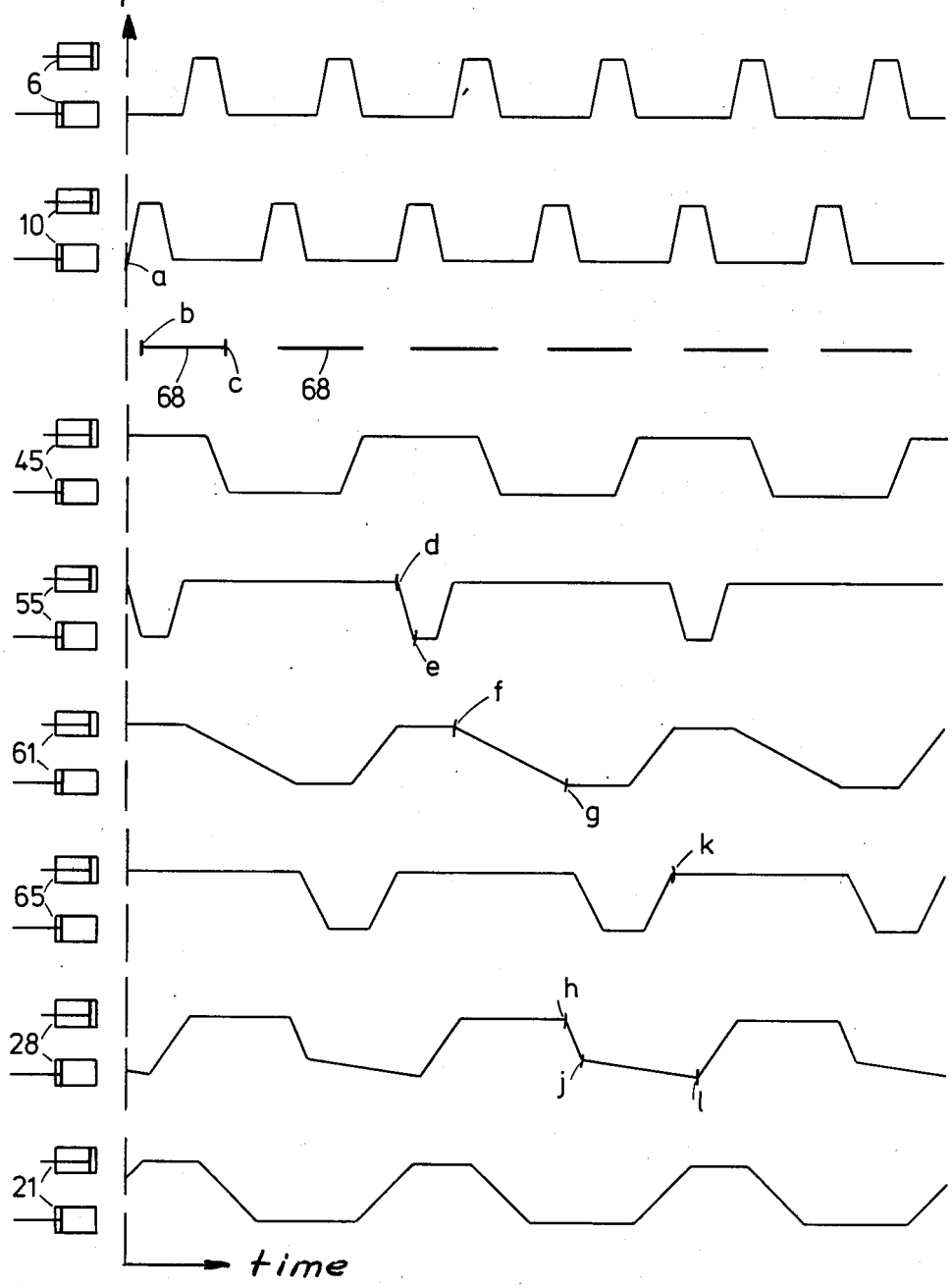

The removal of the crossbars from the store provided in the storing and advancing unit 2 to their proper positions below the spot welding electrodes of the welding station shall now be described with reference to FIG. 8. The diagrams shown therein represent several work cycles of the cylinders 6, 10, 45, 55, 61, 65, 28, 21. The time scale starts at a moment *a* in which a crossbar T2 still rests upon the brackets 9. The cylinders 10 start retracting said brackets, causing the crossbar T2 to be shoved off said brackets. The crossbar drops on to the conveyor belt 11 (time *b*) which accelerates the crossbar and shoots it into the chute 32 in the inverted U-bar 33. The line 68 indicates the time occupied by the longitudinal transit of the crossbar. At the time *c*, the crossbar has been brought to a standstill by the buffer means 34. During the advancement of the crossbar into the chute 32, the cylinder 45 shifts the guide member 49 into a position in which the guide channels 50 are aligned with the rearmost slots **51*d* of the retaining blocks 52. The crossbar drops through the chute 32; on leaving the chute, it encounters the cylindrical surface of the axle 41 and is caused thereby to deviate into the pair of guide channels 50 guiding the crossbar to the slots 51*d*. The piston of the cylinder 55 is retracted, and the bottom orifices of the slots 51*a*, 51*b*, 51*c* and 51*d* are blocked by the blocking plate 54. The crossbar T2 now remains at rest in the slots 51*d* until the time at which the next crossbar T1 will have been deposited in the retaining blocks 52**. The steps or operations for effecting the shifting of the crossbar T1 into said position shall now be described.

Figure 4:
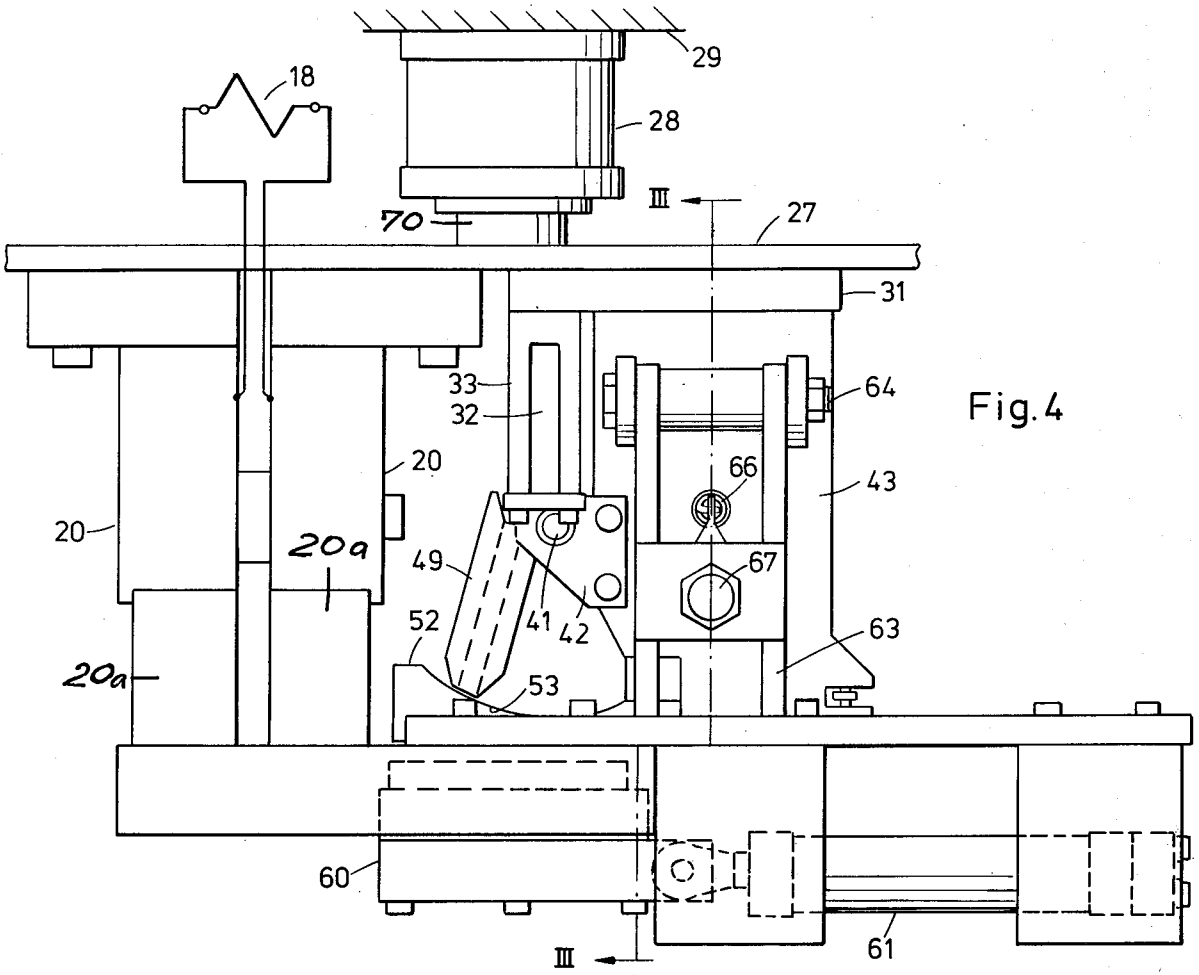
FIG. 4 is a side elevation of the welding unit of FIG. 1.

As soon as the crossbar T2 has been caught by the conveyor belt 11, the cylinders 10 shift the brackets 9 back into the position of FIG. 2. The cylinders 6 are caused to impart a quick backward-forward stroke to the piston rods 7 which accordingly allow the crossbar T1 to drop on to the brackets 9. The crossbar T1 is now removed to the retaining blocks 52 in the same way as the crossbar T2. During the advancement of the crossbar T1 into the chute 32 the guide members 49 are shifted into a position in which the guide channels are aligned with the slots **51*b* of the retaining blocks 52 (FIGS. 4 and 5). The crossbar T1 is accordingly deposited in the slots 51*b* of the retaining block. Shortly thereafter the cylinders 55 shift the blocking plates 54** into the releasing position. This shifting operation is carried out in the time interval *d–e*. The crossbars now drop down into the notches **58*b*, 58*d* of the carrying members 59. The cylinders 61 now shift the carrying members 59 and pair of crossbars supported by them to a position below the contact strips 19** of the welding electrodes. This shifting operation is carried out in the time interval *f–g*. During this interval, the cylinders 65 operating the levers 63 remain in the retracted or inoperative position. The transversal space separating the carrying members 59 is shorter than the length of the crossbars. As soon as the pair of crossbars has attained the proper position below the electrodes, the welding operation is initiated by causing the cylinder 28 to shift the frame 27 downwards (time interval *h–j*). Approximately at the moment in which the contact strips 19 of the electrodes engage the crossbars now resting on the longitudinal members, the cylinders 65 are operated to push the levers 63 outwards into a position in which the spacing of the carrying members 59 exceeds the length of the crossbars. The cylinders 61 now return the carrying members 59 to a position aligned transversally with the retaining members 52 and the blocking plates 54. The plunger 71 of each of the cylinders 65 is now retracted, causing the levers 63 to be returned by the tension springs 66 to their inner positions, in which the carrying members 59 occupy the fetching positions represented in FIG. 3 (time *k*). The welding of the pair of crossbars to the longitudinal members starts at the time *j* and is finished at the time *l*. The displacement-time diagram of the cylinder 28 in the time interval *j–l* is represented schematically only as a straight line. Actually said diagram will have a non-linear shape determined by the progress of the welding operation. When the welding operation has been concluded, the cylinder 28 is made to retract its piston to restore the frame 27 and the various parts supported thereby to the upper position represented in FIGS. 3 to 5.

The required longitudinal advancement of the array of longitudinal members L and the crossbars welded thereto is carried out by a mechanism shown in FIG. 5 comprising a cylinder 21 the piston rod 22 of which operates a longitudinally displaceable slide member 23 pivotally supporting a pawl 24 arranged to engage one T3 of the crossbars welded to the longitudinal elements. The length of stroke of the piston rod 22 is equal to twice the longitudinal spacing of the rests or notches **58*b*, 58*d* of the carrying members 59**.

During the time interval in which the pair of crossbars T1, T2 are removed from the retaining blocks to the welding station and welded to the longitudinal members, an additional pair of crossbars are removed from the store to the retaining blocks by a sequence of operations identical with the one described. The intervals between the supply of successive pairs of crossbars to the welding station are therefore short, which results in a high factor of utilization of the welding station and a high production capacity of the plant as a whole.

In the plant described, the inverter U-bar 33 has a transversal length substantially equal to the length of the crossbars, while the guide members 49 and the retaining blocks 52 as well as the carrying members 59 are arranged to engage end portions only of the crossbars. It is an advantage of this arrangement that a central space between the inverted U-bar 33 and the array of longitudinal members L is available to observation and servicing, so that any jamming of the crossbars or other faults can be quickly detected and dealt with.

The various cylinders are controlled automatically by conventional means such as cam controlled valves or solenoid valves controlled by a program switch unit to provide the sequence of operations above described. Programming means of this kind are familiar to those skilled in the art and require no further description.

I claim:

1. In the method of making welded gratings, steel mats and the like composed of longitudinal members and crossbars welded to said longitudinal members, in which the longitudinal members are advanced longitudinally as a plane horizontal array and the crossbars are successively applied across said array and welded two at a time to the longitudinal members in a welding station by the series spot welding process, the improved method of handling, applying and welding the crossbars which comprises:

a. providing a store of crossbars;

b. removing a first crossbar from said store to a first predetermined position at right angles to the longitudinal members of said array and located above a part of said array which is to enter the welding station, and holding said first crossbar in said predetermined position;

c. removing a second crossbar from said store to a second predetermined position above a part of the array which is to enter the welding station, said first and second positions being on a level with and parallel to each other and spaced by a predetermined spacing;

d. shifting said first and second crossbars simultaneously from said predetermined positions to the welding station along said array while maintaining said predetermined spacing between said crossbars;

e. simultaneously welding said first and said second crossbars to the longitudinal members; and f. repeating said steps (b) to (e) for each of the successive pairs of crossbars to be included in the grating, mat or the like, said steps (b) and (c) in the handling of one pair of crossbars being carried out during the time occupied by said steps (d) and (e) in the handling of the next preceding pair of crossbars.

2. Apparatus for the manufacture of welded gratings, steel mats or the like composed of longitudinal members and crossbars welded to said longitudinal members, comprising:

stationary guiding and supporting means defining a longitudinal path for a horizontal array of longitudinal members;

a vertical reciprocable frame;

a welding station having spot welding electrodes for welding by the series spot welding process, said spot welding electrodes being supported by said vertically reciprocable frame above a portion of said longitudinal path and arranged to weld two crossbars at a time to said array of longitudinal members;

means for shifting said frame between an upper position in which said spot welding electrodes are inoperative and a lower position in which said spot welding electrodes are operative to weld crossbars to said array of longitudinal members;

means for advancing said array step by step along said path through said welding station; and means for successively supplying crossbars to said array to be welded thereto in said welding station, said means comprising:

a. a store of crossbars at a level above said path, b. means for supporting a pair of crossbars at a location above a portion of said longitudinal path passed by said array of longitudinal members prior to its entering said welding station and in a predetermined horizontal position in which said crossbars are parallel to each other and at right angles to the longitudinal members and at a predetermined horizontal spacing from each other, including means for discharging said pair of crossbars downwards from their respective positions defined by said crossbar supporting means, c. means for successively removing pairs of crossbars from said store of crossbars to said crossbar supporting means, d. a pair of longitudinal guide members supported by said reciprocable frame and extending each at one side of said path, e. a pair of carrying members each of which is slidably supported by one of said guide members for displacement between a first terminal position below said crossbar supporting means and a second terminal position in said welding station, said carrying members having rests for the ends of each of the crossbars of said pair, said rests being arranged in said first terminal position to register with the predetermined horizontal crossbar positions defined by said crossbar supporting means, and f. means for shifting said pair of carrying members between said terminal positions, said means being arranged to shift said pair of carrying members to said second terminal position prior to the shifting of said vertically reciprocable frame to its lower position, the level of said rests being such that the crossbars are held clear of the longitudinal members during the shifting toward said second terminal position and lowered onto the longitudinal members by the lowering of said pair of carrying members caused by the shifting downwards of said frame.

3. The apparatus of claim 2 in which each of said longitudinal guide members is supported by a lever pivotably supported by said frame for angular movement about a pivot axis parallel to said path, and including means for swinging said lever between an inner position in which said carrying members are at a distance from each other shorter than the length of the crossbars and an outer position in which said carrying members are at a distance from each other exceeding the length of the crossbars.

* * * * *